US005885340A

United States Patent [19]

Bailey et al.

[11] Patent Number: 5,885,340

[45] Date of Patent: Mar. 23, 1999

[54] QUALITY OF MULTIPLE COATED PAPER

[75] Inventors: David Frederick Bailey; John Claude Husband, both of St Austell, United Kingdom; Ulrika Reimer, Sundsvall, Sweden

[73] Assignee: ECC International Ltd., United Kingdom

[21] Appl. No.: 957,912

[22] Filed: Oct. 27, 1997

Related U.S. Application Data

[63] Continuation-in-part of Ser. No. 543,220, Oct. 13, 1995, abandoned.

[30] Foreign Application Priority Data

Oct. 14, 1994 [GB] United Kingdom ..... 9420777

[51] Int. Cl.[6] ..... L09D 7/12

[52] U.S. Cl. ..... 106/209.1; 106/217.01; 106/287.2; 106/287.25; 427/326; 427/395; 427/402

[58] Field of Search ..... 106/209.1, 217.01, 106/287.2, 287.25; 427/326, 395, 402

[56] References Cited

U.S. PATENT DOCUMENTS

| | | | |
|---|---|---|---|
| 2,627,477 | 2/1953 | Downey . | |
| 3,102,064 | 8/1963 | Wurzburg et al. . | |
| 4,310,360 | 1/1982 | Kvant | 106/306 |
| 4,859,244 | 8/1989 | Floyd | 106/244 |

FOREIGN PATENT DOCUMENTS

| | | |
|---|---|---|
| 0451842 | 11/1991 | European Pat. Off. . |
| 55069658 | 5/1980 | Japan . |
| 61102499 | 5/1986 | Japan . |
| 05044196 | 2/1993 | Japan . |
| 2209355 | 6/1988 | United Kingdom . |
| WO 92/18695 | 10/1992 | WIPO . |

*Primary Examiner*—David Brunsman
*Attorney, Agent, or Firm*—Suzanne Kikel

[57] ABSTRACT

A method of producing a multiple coated cellulosic sheet product having a surface which is smooth, bright and capable of being printed upon, includes the steps of coating a substrate comprising a cellulosic sheet with a first layer of an inorganic pigment-containing aqueous coating composition, and coating the first layer with a second layer of an inorganic pigment-containing aqueous coating composition to form a product in which the first layer is bonded to the cellulosic sheet and the second layer is bonded to and inseparable from the first layer, wherein there is incorporated into the first layer a sizing agent in an amount of up to 0.6% by weight based on the dry weight of the pigment present in the first layer. The sizing agent is selected from alkene ketene dimers, alkenyl succinic anhydrides, and anionic polyurethane sizes.

8 Claims, 4 Drawing Sheets

QUALITY OF MULTIPLE COATED PAPER

This is a continuation-in-part of application Ser. No. 08/543,220 filed Oct. 13, 1995 now abandoned.

BACKGROUND OF THE INVENTION

This invention relates to the improvement of the quality of a multiple coated cellulosic sheet material which is prepared by applying, to a cellulosic sheet material base, two or more layers of a mineral pigment-containing coating composition to form a bonded unitary structure having suitable surface properties.

If a high quality printed image is to be applied to a cellulosic sheet material such as paper or cardboard it is generally necessary to apply to the surface at least one coating composition layer containing one or more mineral pigments such as kaolin clay, calcium carbonate, calcium sulphate, titanium dioxide, barium sulphate, satin white and the like. The application of such a coating composition layer improves the smoothness, gloss, whiteness and opacity of the surface to which the printed image is to be applied. In many cases, in order to obtain a final coated surface of the desired quality, it is necessary to apply two or more layers of pigment-containing coating compositions. For example, a first coating composition layer may be employed to smooth the profile roughness of and cover voids present in the base cellulosic layer and a second coating composition may be employed to adhere to and coat the first layer and to give a better quality surface finish than the first layer and/or complete the pigment coverage or 'hiding' of the underlying base provided by the first layer especially where that is relatively dark, eg. comprising board. The materials of the two or more coating composition layers may be the same or different. Generally, they are different. The pigment material of the outer layer is usually finer and more expensive than that of the first coating composition applied. In any event, the resulting product eventually comprises multiple inseparable layers bonded together as a unitary structure providing a high quality surface on at least one side to which a printed image may be applied.

Paper coating composition layers are applied in a well known way using coating machinery, eg. in which the coating composition is applied to the underlying layer by a so called 'doctor blade'. Generally, in order to receive the maximum return from capital invested in paper coating machinery, it is desirable to run the coating machine at the highest practicable web speed. Also, since the coating compositions consist of pigment, adhesives, and possibly other solid ingredients in suspension in water, it is necessary to remove the water content of the composition by thermal evaporation in order to dry the coatings. In order to minimize the consumption of energy for thermal evaporation it is desirable to operate with coating compositions having the highest possible solids concentrations. However, it is found that when a final coating composition of relatively high solids concentration is applied to a base sheet of relatively high water absorbency, there is a tendency, when a doctor blade is used to remove excess coating composition and smooth the coating, for this final coating to be marred by scratches and other defects.

Where such scratches and defects occur it can be very costly to the manufacturer, since the machinery will need to be stopped sometimes for considerable periods of time, to correct the fault. The general ability to use a paper coating composition continuously in a paper coating operation without difficulty is known in the art as "runnability". Another problem which occurs in the manufacture of multiple coated paper and like products is to obtain good adhesion of an outer coating composition layer to an underlying coating composition layer on a cellulosic sheet. This is because the underlying coating composition layer will usually have a smoothness which is much improved compared with the underlying cellulosic sheet and it is difficult to ensure that the outer layer keys onto the surface of the smoother underlying layer.

An object of the present invention is to provide a method of depositing multiple layers of pigment-containing coating compositions on a base cellulosic sheet in a manner in which the runnability of the product may be improved without significantly interfering with the adhesion between the coating layers.

SUMMARY OF THE PRESENT INVENTION

According to the present invention there is provided a method of producing a multiple coated cellulosic sheet product having a surface which is smooth, bright and capable of being printed upon, the method comprising the steps of coating a substrate comprising a cellulosic sheet with a first layer of an inorganic pigment-containing aqueous coating composition, and coating the first layer with a second layer of an inorganic pigment-containing aqueous coating composition to form a product in which the first layer is bonded to the cellulosic sheet and the second layer is bonded to and inseparable from the first layer, wherein there is incorporated into the first layer a sizing agent in an amount of up to 0.6% by weight based on the dry weight of the pigment present in the first layer, the sizing agent is one of the agents specified hereinafter.

We have found unexpectedly and beneficially, that the use of the sizing agent in this manner meets the aforementioned needs. Thus, by use of such an agent in the first layer, the runnability during coating of the second layer may be improved without significantly causing the adhesion between the first and second layers to be adversely affected.

The use of sizing agents in paper making to give water repellency is well known. Generally, these agents are added in conventional processes to provide internal sizing or surface sizing. U.S. Pat. No. 4962072 (Cooper et al) describes the use of sizing reagent in the coating of papers for use in carbonless copy paper sets. The purpose of this use is to cause water soluble adhesive employed in the edge sealing of the sheets to be repellent to the coatings on the sheets whereby the sheets do not stick together except at their edge and may be readily separated. This is opposite to the objective of the method of the present invention in which it is required for the layers to bond together. Thus, it is quite unexpected that an ingredient used to facilitate non-adhesion of sheets in the prior art may be used in the manner of the present invention wherein bonding is required of two coating composition layers, one containing the ingredient concerned.

DESCRIPTION OF THE INVENTION

In the method of the present invention the substrate may comprise a single cellulosic sheet or multiple cellulosic sheets or a cellulosic sheet deposited on a non-cellulosic material in a board, laminate or like structure. The said cellulosic sheet being coated may have already received one or more coating layers, eg. pigment containing compositions, prior to deposition thereon of the first layer. Thus, the said first layer may be layer adjacent to the said cellulosic sheet or a layer intermediate an underlying layer adjacent to the said cellulosic sheet and an outer layer (the said second layer).

In the method according to the present invention the first layer including the sizing reagent is preferably dried to leave the water content of the first layer less than 10% by weight, preferably between 4% and 7% by weight before the said second layer is applied.

In the method according to the present invention the second layer (and any further coating layers deposited thereon) need not contain any sizing agent.

In the method according to the present invention the sizing agent may comprise an alkene ketene dimer, an alkenyl succinic anhydride or an anionic polyurethane.

An alkene ketene dimer (AKD) is preferred as the sizing agent. This may advantageously be employed in amounts of less than 0.26% by weight based on the dry weight of pigment material(s) in the first layer. Desirably, the amount of AKD employed is in the range 0.01% to 0.1% by weight based on the dry weight of pigment present in the first layer.

The alkene ketene dimer may comprise one or more compounds having the formula:

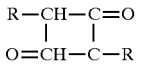

where R is an alkyl group having from 8 to 20 carbon atoms.

Coating compositions for use in coating cellulosic sheet materials vary depending upon the materials to be coated which vary throughout the world depending upon the geography of the region in which the material is produced. As noted above, such compositions may vary from layer-to-layer in a multi-layer coated product.

The composition of each layer may include as adhesive or binder, depending on the type of composition concerned, any one or more of the hydrophilic adhesives known or used in the art, eg. selected from starches and other polysaccharides, proteinaceous adhesives, and latices. Starch is generally less expensive and is preferred for use in the first layer or one of the underlying layers.

The amount of adhesive or binder present in the composition of a given coating layer depends upon whether the composition is to be applied as a relatively dilute or concentrated pigment-containing suspension to the material to be coated. For example, a dilute pigment-containing composition (binder-rich composition) could be employed as a topcoat for underlying more pigment-rich compositions. The adhesive or binder present in the composition may range from 1% to 70% by weight relative to the dry weight of pigment (100% by weight) especially 4% to 50% by weight. Where coating composition is not to be employed as a binder rich composition the adhesive or binder may form from 4% to 30%, eg. 8% to 20%, especially 8% to 15% by weight of the solids content of the composition. The amount employed will depend upon the composition and the type of adhesive, which may itself incorporate one or more ingredients. For example, the following adhesive or binder ingredients may be used in the following stated amounts:

(a) Latex: levels range from 4% by weight for self thickening gravure latices to 20% by weight for board coating latices. The latex may comprise for example a styrene butadiene, acrylic latex, vinyl acetate latex, or styrene acrylic copolymers.

(b) Starch and other binders: levels range from 0 to 50% by weight, eg. 4% by weight to 20% by weight for pigment-rich compositions. The starch may comprise material derived from maize, corn and potato. Examples of other binders include casein and polyvinyl alcohol.

Additives in various known classes may, depending upon the type of coating and material to be coated, be included in the coating composition to be concentrated by the method according to the present invention. Examples of such classes of optional additive are as follows:

(a) Cross linkers: eg. in levels 0 to 5% by weight; for example glyoxals, melamine formaldehyde resins, ammonium zirconium carbonates.

(b) Water retention aids: eg. in up to 2% by weight, for example sodium carboxymethyl cellulose, hydroxyethyl cellulose, PVA (polyvinyl acetate), starches, proteins, polyacrylates, gums, alginates, polyacrylamide bentonite and other commercially available products sold for such applications.

(c) Viscosity modifiers or thickeners: eg. in levels up to 2% by weight; for example polyacrylates, emulsion copolymers, dicyanamide, triols, polyoxyethylene ether, urea, sulphated castor oil, polyvinyl pyrrolidone, montmorillonite, CMC (carboxymethyl celluloses), sodium alginate, xanthan gum, sodium silicate, acrylic acid copolymers, HMC (hydroxymethyl celluloses), HEC (hydroxyethyl celluloses) and others.

(d) Lubricity/Calendering aids: eg. in levels up to 2% by weight, for example calcium stearate, ammonium stearate, zinc stearate, wax emulsions, waxes, alkyl ketene dimer, glycols.

(e) Dispersants: eg. in levels up to 2 per cent by weight, for example polyelectrolytes such as polyacrylates (sodium and ammonium), sodium hexametaphosphates, non-ionic polyol, polyphosphoric acid, condensed sodium phosphate, non-ionic surfactants, alkanolamine and other reagents commonly used for this function.

(f) Antifoamers/defoamers: eg. in levels up to 1% by weight, for example blends of surfactants, tributyl phosphate, fatty polyoxyethylene esters plus fatty alcohols, fatty acid soaps, silicone emulsions and other silicone containing compositions, waxes and inorganic particulates in mineral oil, blends of emulsified hydrocarbons and other compounds sold commercially to carry out this function.

(g) Dry or wet pick improvement additives: eg. in levels up to 2% by weight, for example melamine resin, polyethylene emulsions, urea formaldehyde, melamine formaldehyde, polyamide, calcium stearate, styrene maleic anhydride and others.

(h) Dry or wet rub improvement and abrasion resistance additives: eg. in levels up to 2% by weight, for example glyoxal based resins, oxidised polyethylenes, melamine resins, urea formaldehyde, melamine formaldehyde, polyethylene wax, calcium stearate and others.

(i) Gloss-ink hold-out additives: eg. in levels up to 2% by weight, for example oxidised polyethylenes, polyethylene emulsions, waxes, casein, guar gum, CMC, HMC, calcium stearate, ammonium stearate, sodium alginate and others.

(j) Optical brightening agents (OBA) and fluorescent whitening agents (FWA): eg. in levels up to 1% by weight, for example stilbene derivatives.

(k) Dyes: eg. in levels up to 0.5% by weight.

(l) Biocides/spoilage control agents: eg. in levels up to 1% by weight, for example metaborate, sodium dodecylbenene sulphonate, thiocyanate, organosulphur, sodium benzonate and other compounds sold commercially for this function eg. the range of biocide polymers sold by Calgon Corporation.

(m) Levelling and evening aids: eg. in levels up to 2% by weight, for example non-ionic polyol, polyethylene emulsions, fatty acid, esters and alcohol derivatives, alcohol/ethylene oxide, sodium CMC, HEC, alginates, calcium stearate and other compounds sold commercially for this function.

(n) Grease and oil resistance additives: eg. in levels up to 2% by weight, eg. oxidised polyethylenes, latex, SMA (styrene maleic anhydride), polyamide, waxes, alginate, protein, CMC, HMC.

(o) Water resistance additives: eg. in levels up to 2% by weight, eg. oxidised polyethylenes, ketone resin, anionic latex, polyurethane, SMA, glyoxal, melamine resin, urea formaldehyde, melamine formaldehyde, polyamide, glyoxals, stearates and other materials commercially available for this function.

(p) Insolubiliser: eg. in levels up to 2% by weight.

For all of the above additives, the percentages by weight quoted are based on the dry weight of pigment (100%) present in the composition. Where the additive is present in a minimum amount the minimum amount may be 0.01% by weight based on the dry weight of pigment.

The method according to the present invention may be carried out in a known way which will depend upon the material to be coated, the coating composition(s) to be applied and other factors as determined by the operator, eg. speed and ease of runnability eg. using a conventional coating machine.

Methods of coating paper and other sheet materials with one or more coating layers are widely published and well known. For example, there is a review of such methods published in Pulp and Paper International, May 1994, page 18 et seq. Sheets may be coated on the sheet forming machine, ie. "on-machine", or "off-machine" on a coater or coating machine. Use of high solids compositions is desirable in the coating method because it leaves less water to evaporate subsequently. However, as is well known in the art, the solids level should not be so high that high viscosity and levelling problems are introduced.

All known methods of coating for use in the method according to the present invention require (i) a means of applying the coating composition to the material to be coated, viz an applicator; and (ii) a means for ensuring that a correct level of coating composition is applied, viz a metering device.

When an excess of coating composition is applied to the applicator, the metering device is downstream of it. Alternatively, the correct amount of coating composition may be applied to the applicator by the metering device, eg. as a film press. At the points of coating application and metering, the paper web support ranges from a backing roll, eg. via one or two applicators, to nothing (ie: just tension). The time the coating is in contact with the paper before the excess is finally removed is the dwell time—and this may be short, long or variable.

The coating is usually added by a coating head at a coating station. When providing more than one coat, the initial coat (precoat) may as noted above have a cheaper formulation. A coater that is applying a double coating, ie. a coating on each side of the paper, will have two or four coating heads, depending on the number of sides coated by each head. Most coating heads coat only one side at a time, but some roll coaters (eg. film press, gate roll, size press) coat both sides in one pass.

Examples of known coaters which may be employed in step (b) include air knife coaters, blade coaters, rod coaters, bar coaters, multi-head coaters, roll coaters, roll/blade coaters, cast coaters, laboratory coaters, gravure coaters, kiss coaters, liquid application systems, reverse roll coaters and extrusion coaters.

Embodiments of the present invention will now be described by way of example with reference to the following Examples and the accompanying drawings.

DESCRIPTION OF ILLUSTRATIVE EMBODIMENTS

Example 1

Figure 1:
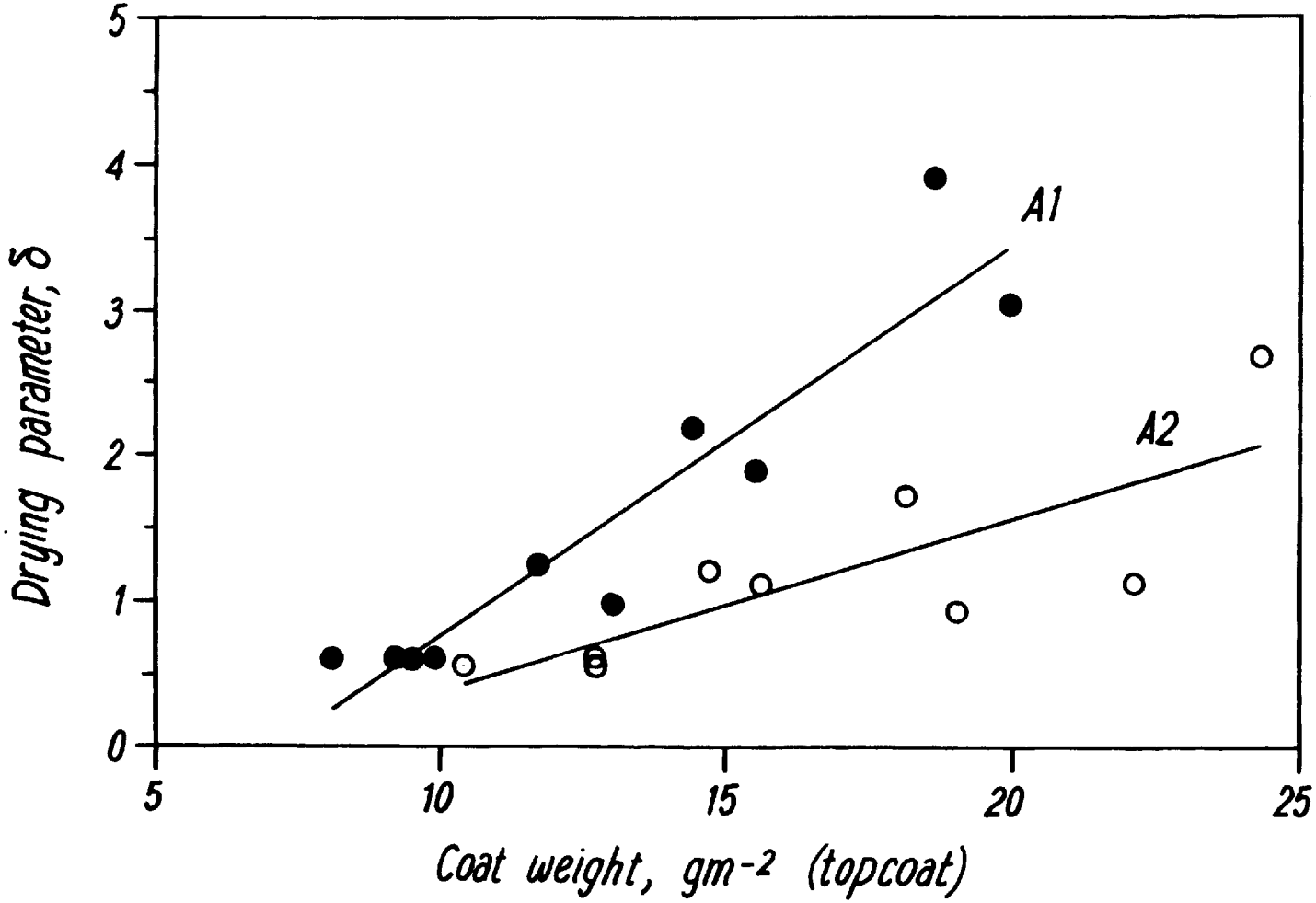
FIGS. 1 to 4 of the drawings are graphs that are referred to in the following Examples, which illustrates the invention.

Three coating compositions were prepared for use in providing the first of two coatings applied to a base paper to form a double coated paper. Each composition was prepared according to the general recipe:

| Ingredient | Parts by Weight |
|---|---|
| Calcium carbonate pigment | 100 |
| Adhesive | 15 |

The calcium carbonate pigment was a comminuted natural marble which had a particle size distribution such that 60% by weight consisted of particles having an equivalent spherical diameter smaller than 2 $\mu$m.

The adhesive used in each of the three compositions was:

A 15 parts by weight of starch

B 12 parts by weight of starch and 3 parts by weight of latex solids

C 10 parts by weight of starch and 5 parts by weight of latex solids

The starch was an oxidised corn starch which is marketed by Cerestar under the trade name "AMISOL 05591". The latex contained 50% by weight of styrene butadiene rubber polymer and is marketed by The Dow Chemical Company under the trade name "DOW 950". The amounts of latex used in the recipes given above are expressed in terms of the weight of dry polymer solids.

Each composition was divided into two portions, 1 and 2. To Portion 1 there was added 0.25 parts by weight, on a dry weight basis, per hundred parts by weight of calcium carbonate pigment, of a weakly cationic alkyl ketene dimer which is marketed by the Hercules Corporation under the trade name "AQUAPEL C519". No alkyl ketene dimer was added to Portion 2.

Each composition was applied to an unsized, absorbent, woodfree base paper by means of a laboratory paper coating machine of the type described in British Patent Specification No. 1032536 at a paper speed of 400 m.min$^{-1}$. In each case the coating was dried by blowing air over it for 2 minutes.

Each sample of paper coated with a first coating composition was then coated by means of a laboratory bench blade coating apparatus with a second composition having the general formula:

| Ingredient | Parts by Weight |
|---|---|
| Fine calcium carbonate pigment | 100 |
| Latex adhesive | 12 |
| Sodium carboxymethyl cellulose | 1 |

The fine calcium carbonate pigment was a comminuted natural marble having a particle size distribution such that 95% by weight consisted of particles having an equivalent spherical diameter smaller than 2 $\mu$m. The latex adhesive was the same as that used for the first coat, and the sodium carboxymethyl cellulose was that marketed by Metsa Serla under the trade name "FINNFIX 5". Each sample of paper coated with each of the six different first coating compositions was divided into a number of portions and the blade pressure in the coating apparatus was varied to give a series of different weights per unit area of the second composition in the range from 8 to 20 g.m$^{-2}$.

The coating apparatus was provided with a device which monitored the rate of drying of the second coating composition by measuring the intensity of light reflected from the surface of the coated paper. The coating immediately after passing beneath the blade was uniformly wet and was therefore highly reflective to light. However, as the coating dried it became duller in appearance. An adjustable light source and a detector were mounted above the coating apparatus to give an incident light beam and a measured beam both at an angle of 75% to the normal to the paper. The signal from the detector was applied by way of a voltage measurement interface to an input of a personal computer. The computer was capable of recording up to 15,000 measurements of light intensity per second, so, in order to provide 150 data points per second, the average of 100 such measurements was calculated to give each data point.

For each sample of paper to be coated, measurements of reflected light intensity were made for about 2 seconds on dry paper. The coating apparatus was then started and a drying curve of light intensity against time was recorded by the computer. A typical drying curve takes the form of an initial drop in light intensity to near zero as the blade passes beneath the source and detector, followed by a rapid increase in intensity as the wet coating film is exposed. The intensity will then begin to decrease as the coating dries and will eventually become constant to give a measure of the reflectance of light from the dry coated paper. For each sample of paper, the rate of drying was expressed as a drying parameter, d. The value of d was determined precisely by plotting the rate of change of light intensity with time and reading as d the time interval between the maximum positive gradient of the light intensity/time curve, when the wet coating is first sensed, and the greatest negative gradient of this curve, when the rate of change of light intensity is at a maximum and the coating is in a partially dried state.

Figure 2:
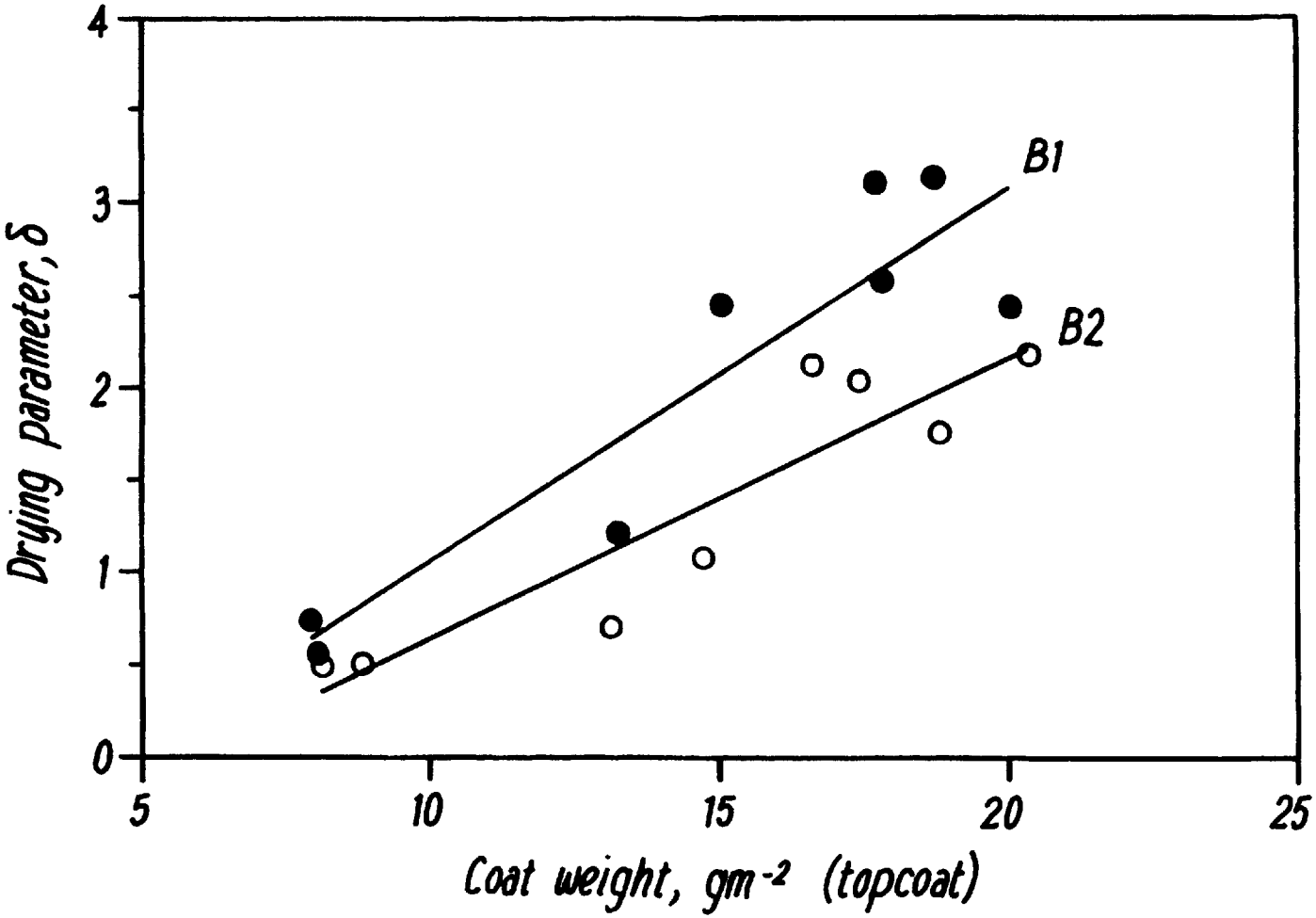
Figure 3:
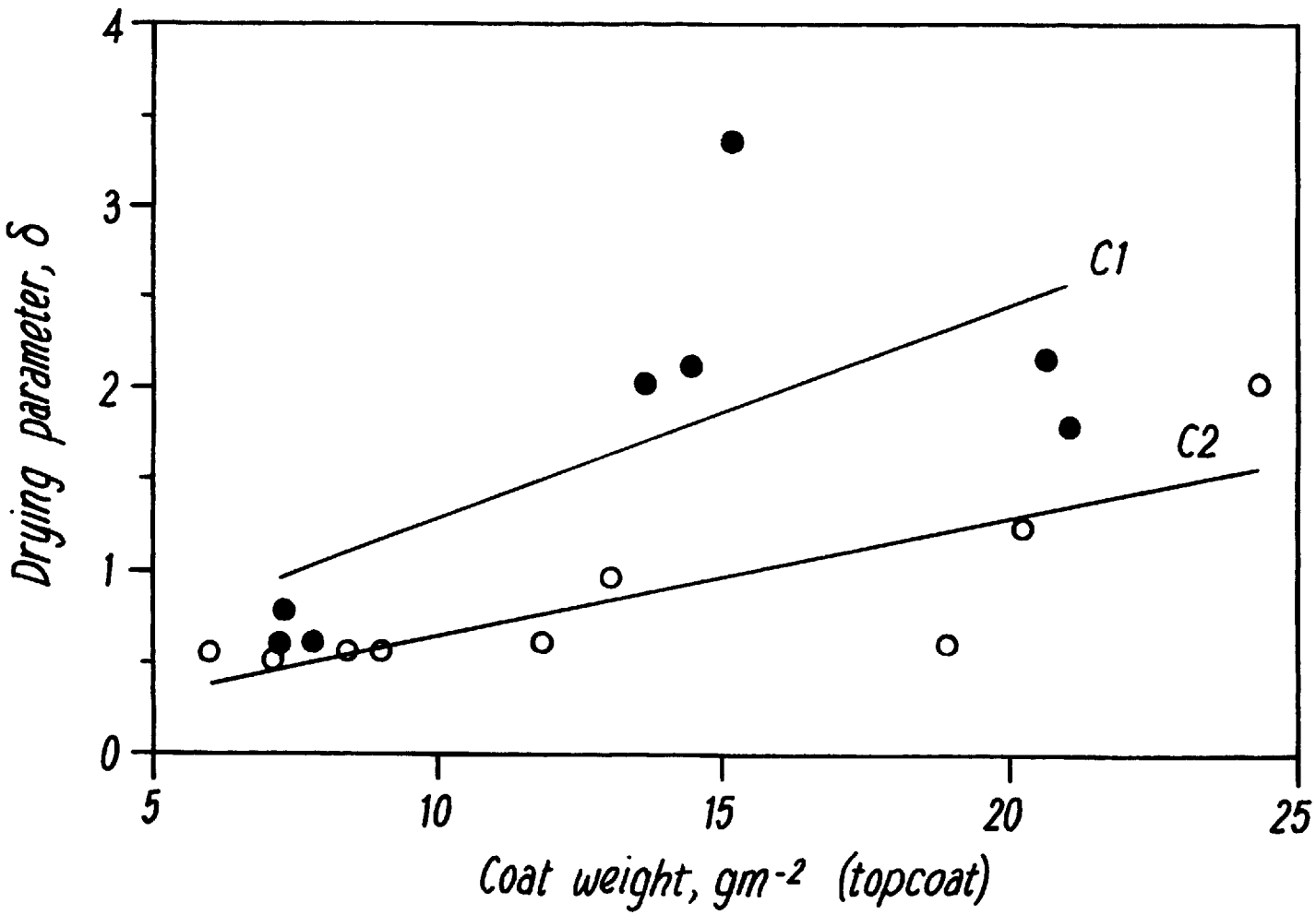

For each of the six first coating compositions a graph was plotted of drying parameter, d, against coat weight and the results are shown in FIGS. 1–3. FIG. 1 gives the results for first coating compositions A1 and A2, with and without the alkyl ketene dimer, respectively; FIG. 2 gives the results for first coating compositions B1 and B2 and FIG. 3 gives the results for first coating compositions C1 and C2.

It will be noted that in every case the drying parameter, d, and hence the drying time, increases with coat weight, but that, for each adhesive system used in the first coating composition, the second coat dries more slowly when the alkyl ketene dimer is added to the first coating composition.

Example 2

Batches of an absorbent woodfree base paper of weight 83 g.m$^{-2}$ were precoated with four different first coating compositions, each of which was prepared to the general recipe:

| Ingredient | Parts by weight |
|---|---|
| Calcium carbonate pigment | 100 |
| Oxidised starch adhesive | 18 |
| Sodium hydroxide | to pH 8.5 |
| Alkyl ketene dimer | see below |
| Water | to 62% solids |

The calcium carbonate pigment was the same as that used in the first coating in Example 1.

The amounts of the alkyl ketene dimer in the four compositions were, respectively, 0, 0.02, 0.05 and 0.1 parts by weight of active alkyl ketene dimer per 100 parts by weight of the pigment. The alkyl ketene dimer was the same as that used in Example 1. The alkyl ketene dimer, when used, was added into the composition after the starch adhesive at a temperature below 40° C.

The first coating composition was applied to the base paper in each case by means of a pilot-scale paper coating machine fitted with a roll applicator and a doctor blade at a web speed of 600 m.min$^{-1}$ and a blade angle of 49%. The blade pressure was adjusted to give a coat weight of 10 g.m$^{-2}$. In order to minimise curl of the paper during the second coating, a first coating was also applied to the reverse side of the paper web at a coat weight of 8.5 g.m$^{-2}$.

After the first coating had been applied to each batch of paper, the surface of the coated paper was calendered by passing it through two nips of a supercalender at a line pressure of 50 kN.m$^{-1}$ at 60° C. and at a speed of 600 m.min$^{-1}$.

Each sample of paper coated with a first coating composition was then coated with a second coating composition having the general formula:

| Ingredient | Parts by Weight |
|---|---|
| Fine calcium carbonate pigment | 100 |
| Styrene butadiene latex | 12 |
| Sodium carboxymethyl cellulose | 1 |
| Optical brightening agent | 0.5 |

The fine calcium carbonate pigment, the latex and the sodium carboxy methyl cellulose were the same as those used in Example 1.

The second coat was applied to each batch of precoated paper by means of a pilot-scale paper coating machine fitted with a roll applicator and a doctor blade. The blade pressure was kept constant at a suitable value which would give a coat weight of the second coating of 9 g.m$^{-2}$.

The runnability, or resistance to scratching, of the second coating was investigated by the following procedure:

A second coat was applied first to a batch of base paper which had been precoated with a first coating composition containing no alkyl ketene dimer. The second coating composition was applied at a web speed of 300 m.min$^{-1}$ was observed, the base paper was changed to a base paper which had been precoated with a first coating composition which contained some alkyl ketene dimer, and a second coat was applied to this paper keeping the second coating composition and the coating machine settings unchanged. If an improvement in the resistance to scratching was observed, the web speed was increased until scratching was observed, or until a web speed of 800 m.min$^{-1}$ was reached.

The second coating composition was then diluted with water by about 1–2% by weight of solids and coated on to the base paper which had been precoated with a first coating containing no alkyl ketene dimer. The procedure was then repeated until no scratching could be detected during the application of a second coat to the base paper which had been precoated with the first coating which contained no alkyl ketene dimer.

The whole procedure was then repeated using the base papers which had been precoated with the first coatings which contained different amounts of the alkyl ketene dimer.

The results are set forth in Table 1 below:

TABLE 1

| Amount of alkyl ketene dimer in first coat (pph) | % by weight solids in second coat | web speed ($m.min^{-1}$) | Observations |
|---|---|---|---|
| 0 | 69.0 | 300 | Frequent scratching |
| 0 | 67.4 | 300 | Slight scratching |
| 0 | 65.7 | 300 | Slight scratching |
| 0 | 63.9 | 300 | No scratching |
| 0.02 | 68.4 | 300 | Slight scratching |
| 0.02 | 66.8 | 300 | No scratching |
| 0.02 | 66.8 | 800 | No scratching |
| 0.05 | 66.6 | 800 | No scratching |
| 0.10 | 68.6 | 300 | No scratching |
| 0.10 | 68.6 | 600 | Scratching reappeared |
| 0.10 | 66.9 | 600 | No scratching |

Note: "pph" means parts by weight per 100 parts by weight of pigment.

These results show that scratching was most pronounced when a second coating composition was being applied at a high solids concentration (68–69% by weight) on to a base paper which had been precoated with a first coating composition containing no alkyl ketene dimer. The inclusion of only 0.02 parts by weight of alkyl ketene dimer into the first coating composition was sufficient to reduce scratching markedly when a second coating composition was applied at a solids concentration of 68–69% by weight. When a first coating containing 0.1 parts by weight of alkyl ketene dimer was applied, scratching during the application of a second coating composition was completely eliminated under the same conditions.

Example 3

Batches of an absorbent woodfree base paper of weight 94 $g.m^{-2}$ were precoated with three different first coating compositions having the following recipes:

1. 100 parts by weight calcium carbonate pigment A; 15 parts by weight oxidised corn starch.
2. 100 parts by weight calcium carbonate pigment B; 15 parts by weight oxidised corn starch; 0.6 part by weight sodium salt of styrene-maleic acid copolymer.
3. 100 parts by weight calcium carbonate pigment A; 15 parts by weight oxidised corn starch; 0.25 part by weight alkenyl succinic anhydride.

Calcium carbonate pigment A was the same as that used in the first coating in Example 1.

Calcium carbonate pigment B was a natural marble which was comminuted to a similar particle size distribution as that of calcium carbonate pigment A, but in an aqueous suspension of lower solids concentration and in the absence of a dispersing agent. The oxidised corn starch was the same as that used in Example 1.

The sodium salt of the styrene-maleic acid copolymer was supplied by Atochem under the trade name "SMA 3000".

The alkenyl succinic anhydride was supplied by Claymore Chemicals Limited under the trade name "CLAYSIZE PR4".

In each case the oxidised corn starch was added to the coating composition in the form of a 30% by weight solution which was cooked at 90° C. for 20 minutes before addition.

In the case of compositions 1 and 3, the cooked starch solution was added to an aqueous suspension containing 78% by weight of calcium carbonate pigment A and a sodium polyacrylate dispersing agent. In the case of composition 3, the alkenyl succinic anhydride was mixed in to the composition immediately before coating.

Composition 2 was prepared by mixing 1333 g of a cake containing 75% by weight of the dry calcium carbonate pigment B with 6 g of the sodium salt of the styrene-maleic acid copolymer. A deflocculated suspension of the calcium carbonate pigment at a solids concentration of 74.4% by weight was obtained.

Each first coating composition was applied to the base paper by means of the laboratory paper coating machine described in Example 1 at a paper speed of 400 $m.min^{-1}$ and a blade angle of 35%. The blade angle was adjusted, if necessary, to give a coat weight of 8.0±0.5 $g.m^{-2}$ for each first composition. The coatings were dried by infrared heating for 25 seconds with a current of hot air followed by 25 seconds during which cold air was blown over the coated surface.

Each sample of paper coated with a first coating composition was then coated by means of the laboratory bench blade coating apparatus with a second coating composition having the general formula:

| Ingredient | Parts by Weight |
|---|---|
| Fine calcium carbonate pigment | 100 |
| Latex adhesive | 12 |
| Sodium carboxymethyl cellulose | 1 |

Figure 4:
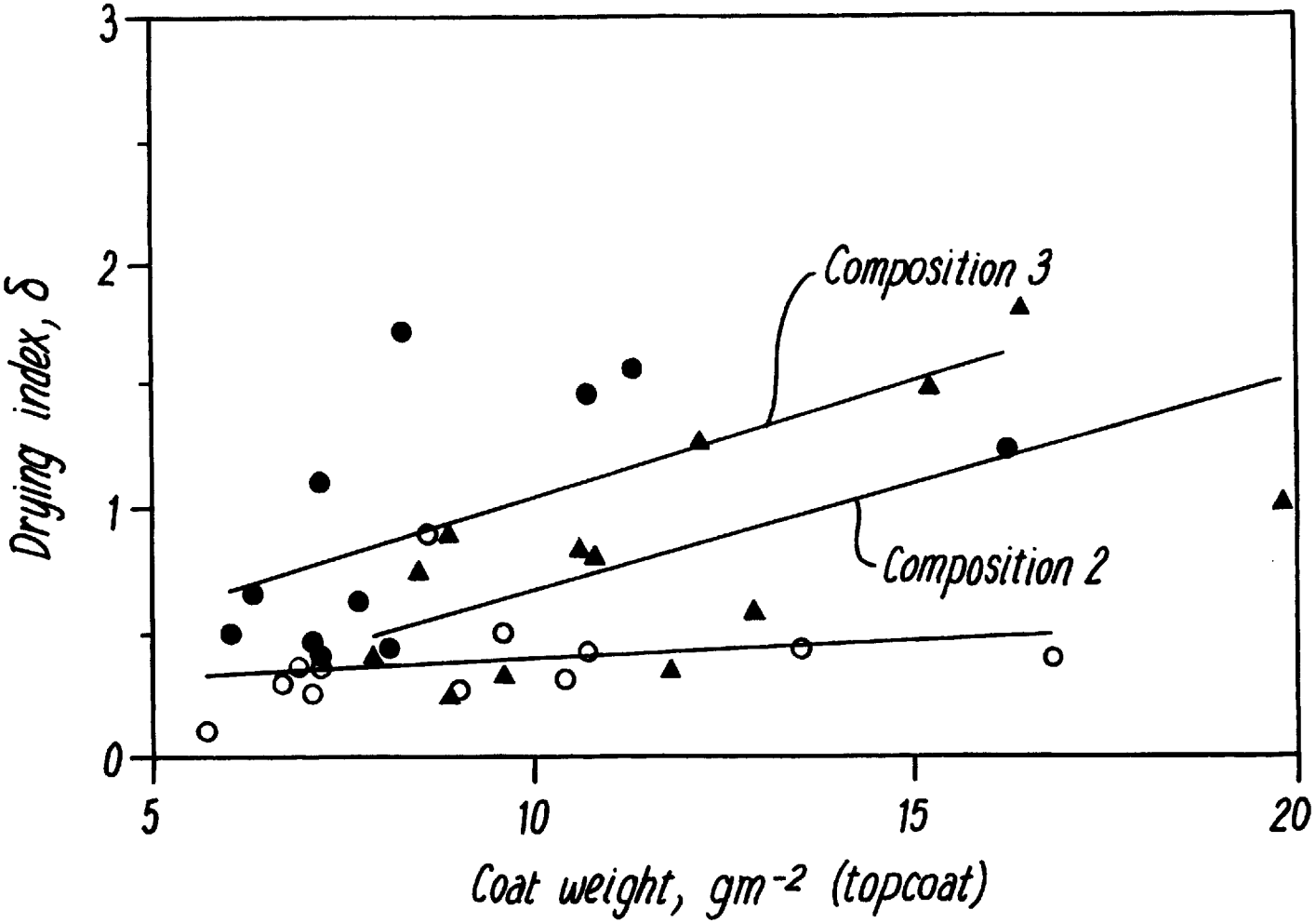

The fine calcium carbonate pigment, the latex adhesive and the sodium carboxymethyl cellulose were the same as those used in Example 1. Each sample of paper coated with each of the three different first coating compositions was divided into a number of portions and the blade pressure in the bench coating apparatus was varied to give a series of different weights per unit area of the second coating composition in the range from 8 to 20 $g.m^{-2}$. For each first coating composition a graph was drawn of drying parameter, d, against coat weight, and the results are shown in FIG. 4. It will be seen that for the control first coating composition 1 the drying parameter remains virtually constant with second composition coat weight, while in the case of first compositions 2 and 3, in accordance with the invention, the drying parameter increases steeply with second composition coat weight, indicating that the second coat dries more slowly when a sizing reagent is added to the first composition. Example 4

Batches of an absorbent woodfree base paper of weight 83 $g.m^{-2}$ were precoated with three different first coating compositions, each of which was prepared to the general recipe:

| Ingredient | Parts by weight |
|---|---|
| Calcium carbonate pigment | 100 |
| Oxidised starch adhesive | 18 |
| Sodium hydroxide | to pH 8.5 |
| Sizing reagent | see below |
| Water | to 62% solids |

The calcium carbonate pigment was the same as that used in the first coating composition in Example 1.

The sizing reagent was an anionic polyurethane marketed by Eka Nobel under the trade name "CYCLOPAL A" and the amounts used in the three compositions were, respectively, 0, 0.1 and 0.2 parts by weight of active anionic polyurethane per 100 parts by weight of the pigment. The anionic polyurethane was added into the composition before the starch adhesive.

The first coating composition was applied to the base paper in each case by means of a pilot-scale paper coating machine fitted with a roll applicator and a doctor blade at a web speed of 600 $m.min^{-1}$ and a blade angle of 49°. The blade pressure was adjusted to give a coat weight of 10 $g.m^{-2}$. It was not necessary in this case to apply a first coating to the reverse side of the paper web, as the paper coated on one side only was found, after calendering, to have sufficient resistance to curling.

After the first coating had been applied to each batch of paper, the surface of the coated paper was calendered by passing it through two nips of a supercalender at a line pressure of 50 $kN.m^{-1}$ at 60° C. and at a speed of 600 $m.min^{-1}$.

Each sample of paper coated with a first coating composition was then coated with a second coating composition having the general formula:

| Ingredient | Parts by Weight |
|---|---|
| Fine calcium carbonate pigment | 100 |
| Styrene butadiene latex | 12 |
| Sodium carboxymethyl cellulose | 1 |
| Optical brightening agent | 0.5 |

The fine calcium carbonate pigment, the latex and the sodium carboxy methyl cellulose were the same as those used in Example 1.

The second coat was applied to each batch of precoated paper by means of a pilot-scale paper coating machine fitted with a roll applicator and a doctor blade. The blade pressure was kept constant at a suitable value which would give a coat weight of the second coating of 9 $g.m^{-2}$.

The runnability, or resistance to scratching, of the second coating was investigated by the procedure described in Example 2. The results are set forth in Table 2 below:

TABLE 2

| Amount of polyurethane in first coat (pph) | % by weight solids in second coat | web speed ($m.min^{-1}$) | Observations |
|---|---|---|---|
| 0 | 69.2 | 500 | Frequent scratching |
| 0 | 69.2 | 1000 | Frequent scratching |
| 0 | 67.2 | 500 | No scratching |
| 0.1 | 69.0 | 500 | Slight scratching |
| 0.1 | 69.0 | 1000 | No scratching |
| 0.2 | 69.1 | 300 | No scratching |
| 0.2 | 69.1 | 1000 | No scratching |

These results show that the inclusion of the anionic polyurethane into the first coating composition at a level of 0.1 part by weight per 100 parts by weight of pigment greatly reduces scratching when the second coating composition is applied at a solids concentration of about 69% by weight.

We claim:

1. A method of producing a multiple coated cellulosic sheet product having a surface which is smooth, bright and capable of being printed upon, the method comprising the steps of coating a substrate comprising a cellulosic sheet with a first layer of an inorganic pigment-containing aqueous coating composition, and coating the first layer with a second layer of an inorganic pigment-containing aqueous coating composition to form a product in which the first layer is bonded to the cellulosic sheet and the second layer is bonded to and inseparable from the first layer, wherein there is incorporated into the first layer a sizing reagent in an amount of 0.01 to 0.6% by weight based on the dry weight of the pigment present in the first layer, wherein the sizing agent is selected from alkene ketene dimers, alkenyl succinic anhydrides, and anionic polyurethane sizes.

2. A method as claimed in claim 1 wherein at least one further coating layer is applied to the cellulosic sheet material under or on the said first layer and under the said second layer.

3. A method as claimed in claim 1 and wherein the first layer is dried before it is coated.

4. A method as claimed in claim 1 and wherein the sizing agent comprises an alkene ketene dimer and is present in the first layer in an amount of about 0.2% or less based on the dry weight of pigment present in the first layer.

5. A method as claimed in claim 4 and wherein the amount of alkene ketene dimer present in the first layer is from about 0.01% by weight to about 0.1% by weight based on the dry weight of the pigment present in the first layer.

6. A method as claimed in claim 1 and wherein the first layer includes from about 4% to about 20% by weight of a starch binder based on the dry weight of pigment present in the layer and a pigment which comprises calcium carbonate.

7. A method as claimed in claim 6 and wherein the calcium carbonate is such that between about 50% and about 70% of its particles have sizes less than 2 $\mu$m.

8. A method as claimed in claim 1 and wherein the calcium carbonate is such that between about 50% and about 70% of its particles have sizes less than about 2 $\mu$m.

* * * * *